US008752652B2

(12) United States Patent
Buchanan et al.

(10) Patent No.: US 8,752,652 B2
(45) Date of Patent: Jun. 17, 2014

(54) CORING APPARATUS AND METHODS TO USE THE SAME

(75) Inventors: Steven E. Buchanan, Pearland, TX (US); Lennox E. Reid, Jr., Houston, TX (US); Rachel Agnes Lavaure, Tokyo (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 53 days.

(21) Appl. No.: 13/230,374

(22) Filed: Sep. 12, 2011

(65) Prior Publication Data

US 2012/0000711 A1 Jan. 5, 2012

Related U.S. Application Data

(63) Continuation of application No. 12/603,855, filed on Oct. 22, 2009, now Pat. No. 8,210,284.

(51) Int. Cl.
*E21B 49/00* (2006.01)

(52) U.S. Cl.
USPC ..... 175/78; 73/152.11

(58) Field of Classification Search
USPC ..... 166/100, 264; 175/77–79, 58, 20; 73/152.11, 152.09
See application file for complete search history.

(56) References Cited

U.S. PATENT DOCUMENTS

| | | | | | |
|---|---|---|---|---|---|
| 2,184,343 | A | * | 12/1939 | Harrington | 175/235 |
| 2,594,292 | A | * | 4/1952 | Cornelius | 175/78 |
| 4,354,558 | A | | 10/1982 | Jageler et al. | |
| 4,461,360 | A | | 7/1984 | Mount, II | |
| 4,466,495 | A | | 8/1984 | Jageler | |
| 4,714,119 | A | | 12/1987 | Hebert et al. | |
| 5,092,716 | A | * | 3/1992 | Omi | 408/59 |
| 5,411,106 | A | | 5/1995 | Maissa et al. | |
| 5,439,065 | A | | 8/1995 | Georgi | |
| 5,667,025 | A | | 9/1997 | Haessly et al. | |
| 6,116,358 | A | * | 9/2000 | Fanuel | 175/250 |
| 6,167,968 | B1 | | 1/2001 | Allarie et al. | |
| 6,371,221 | B1 | | 4/2002 | Harrigan et al. | |
| 6,659,204 | B2 | | 12/2003 | Aumann et al. | |
| 7,178,449 | B2 | | 2/2007 | Porel | |
| 7,191,831 | B2 | | 3/2007 | Reid et al. | |
| 2004/0140126 | A1 | | 7/2004 | Hill et al. | |
| 2008/0078582 | A1 | | 4/2008 | Phan et al. | |
| 2009/0114447 | A1 | | 5/2009 | Reid, Jr. et al. | |

* cited by examiner

*Primary Examiner* — Shane Bomar
*Assistant Examiner* — Kipp Wallace
(74) *Attorney, Agent, or Firm* — Cathy Hewitt

(57) ABSTRACT

An apparatus for conveyance via wireline or drillstring in a wellbore extending into a subterranean formation, the apparatus comprising a coring bit assembly, a first motor operatively coupled to the coring bit assembly via a gear box to rotationally drive the coring bit assembly, and a second motor to drive the coring bit assembly into the formation while the coring bit assembly is rotated by the first motor, wherein the coring bit assembly comprises a feature to permit the coring bit assembly to be broken when the coring bit assembly becomes stuck in the formation.

25 Claims, 12 Drawing Sheets

CORING APPARATUS AND METHODS TO USE THE SAME

CROSS-REFERENCE TO RELATED APPLICATIONS

This application is a continuation of U.S. application Ser. No. 12/603,855, filed Oct. 22, 2009, now U.S. Pat. No. 8,210, 284, the entire disclosure of which is hereby incorporated by reference herein.

BACKGROUND

Wellbores or boreholes may be drilled to, for example, locate and produce hydrocarbons. During a drilling operation, it may be desirable to evaluate and/or measure properties of encountered formations, formation fluids and/or formation gasses. An example property is the phase-change pressure of a formation fluid, which may be a bubble point pressure, a dew point pressure and/or an asphaltene onset pressure depending on the type of fluid. In some cases, a drillstring is removed and a wireline tool deployed into the wellbore to test, evaluate and/or sample the formation(s), formation gas (ses) and/or formation fluid(s). In other cases, the drillstring may be provided with devices to test and/or sample the surrounding formation(s), formation gas(ses) and/or formation fluid(s) without having to remove the drillstring from the wellbore. Some formation evaluations may include extracting a core sample from sidewall of a wellbore. Core samples may be extracted using a hollow coring bit.

DETAILED DESCRIPTION

Figure 1A:
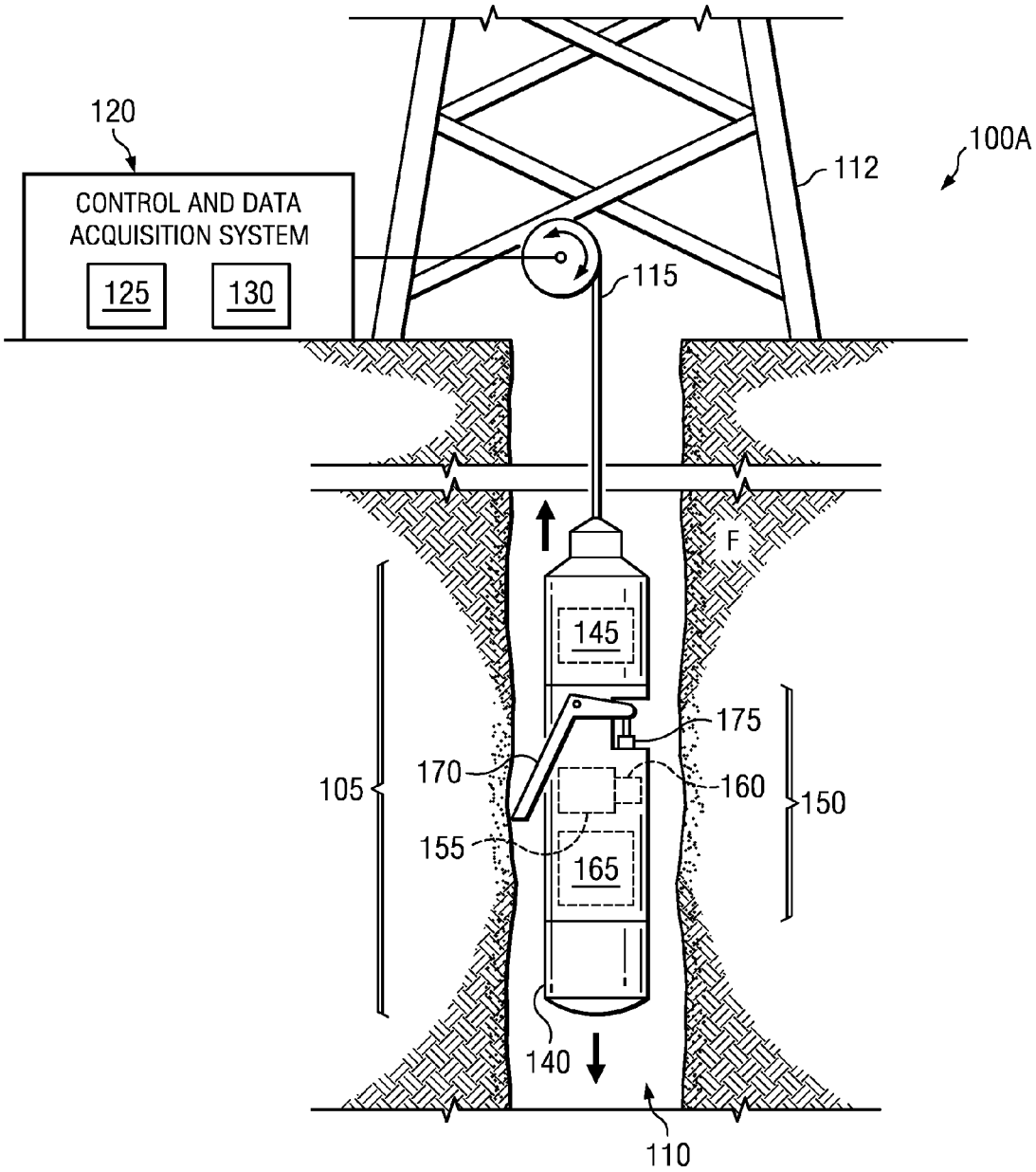
FIG. 1A is a schematic of a wellsite wireline system according to one or more aspects of the present disclosure.

Certain examples are shown in the above-identified figures and described in detail below. The figures are not necessarily to scale and certain features and certain views of the figures may be shown exaggerated in scale or in schematic for clarity and/or conciseness. It is to be understood that while the following disclosure provides many different embodiments or examples for implementing different features of various embodiments, other embodiments may be implemented and/or structural changes may be made without departing from the scope of this disclosure. Further, while specific examples of components and arrangements are described below these are, of course, merely examples and are not intended to be limiting. In addition, the present disclosure may repeat reference numerals and/or letters in the various examples. This repetition is for the purpose of clarity and does not in itself dictate a relationship between the various embodiments and/or example configurations discussed. Moreover, the depiction of a first feature over or on a second feature in the description that follows may include embodiments in which the first and second elements are implemented in direct contact, and may also include embodiments in which other elements may be interposed between the first and second elements, such that the first and second elements need not be in direct contact.

This disclosure relates to apparatus and methods for obtaining core samples from subterranean formations. According to one or more aspects of this disclosure, a coring tool for use in a wellbore or borehole formed in a subterranean formation may include a tool housing adapted for suspension within a wellbore at a selected depth. The tool housing may include a coring aperture formed in the tool housing and a coring apparatus disposed in the tool housing. The coring apparatus may be selectively pivotable within the tool housing between one or more of a storage or eject position, a coring position and/or a sheering position. The coring apparatus may include a coring bit assembly having a cutting end. The coring bit assembly may be operably coupled to a coring motor via a gear box, which may be configured to rotate the coring bit. The coring bit may extend and retract longitudinally through the coring aperture. To allow the coring bit assembly to cut a core sample on any angle, the coring motor and gear box may pivot together with the coring apparatus. The gear box may include a gear drive and a key member configured to engage an inner surface of the gear drive and an outer surface of the coring bit assembly. The key member may be configured to maintain a rotational relationship between the gear drive and the coring bit assembly. The gear box may further include a pinion configured to engage an outer surface of the gear drive. The coring motor may be operatively coupled to the pinion to rotate the gear drive and, thus, the coring bit assembly.

The coring apparatus may also include a pivotably connected extension link arm having a first end pivotably coupled to the tool housing and a second end to move the coring bit assembly between retracted and extended positions. An actuator may be operably coupled to the first end of the extension link arm and may be configured to actuate the coring bit assembly between the retracted and extended positions.

The coring apparatus may further include an additional pivotably connected extension arm having a first end pivotably coupled to the tool housing and a second end to pivot or rotate the coring apparatus within the tool housing. A second actuator may be operably coupled to the first end of the additional extension link arm to pivot the coring apparatus. Pivoting of the coring apparatus may simultaneously pivot the coring bit, the coring motor, the gear box, the gear drive, the key member and the pinion. The additional extension arm may include an intermediate link arm having a hydraulic flow line to fluidly couple hydraulic fluid to drive the coring motor.

The coring apparatus may still further include a coring sleeve having one or more protrusions configured to scribe, mark and/or score a core sample as the coring bit assembly extends into the formation. One or more marks formed on the core sample by the protrusion(s) may be used to determine the orientation of the core sample with respect to the wellbore. The coring bit assembly may include one or more grooves, ribs and/or vanes on an inner surface of the coring bit assembly to pump, force and/or circulate mud toward a cutting end of the coring bit assembly via a fluid passageway between the coring bit and the coring sleeve.

Other example coring tools and methods are described in U.S. Patent Publication No. 2009/0114447, entitled "Coring Tool and Method," and published May 7, 2009; U.S. Pat. No. 4,714,449, entitled "Apparatus for Hard Rock Sidewall Coring a Borehole," and granted Dec. 22, 1987; and U.S. Pat. No. 5,667,025, entitled "Articulated Bit-Selector Coring Tool," and granted Sep. 16, 1997, each of which is assigned to the assignee of the present application, and each of which is hereby incorporated by reference in its entirety.

While the example apparatus and methods disclosed herein are described in the context of wireline and drillstring tools, they are also applicable to any number and/or type(s) of additional and/or alternative downhole tools such as coiled tubing deployed tools. One or more aspects of this disclosure may also be used in other coring applications such as in-line coring.

Wellbores may be drilled into the ground or ocean bed to recover natural deposits of oil and/or gas, as well as other desirable materials that are trapped in geological formations in the Earth's crust. A wellbore may be drilled using a drill bit attached to the lower end of a drillstring. Drilling fluid or mud may be pumped down through the drillstring to the drill bit. The drilling fluid may be used to lubricate the drill bit, cool the drill bit and/or to carry formation cuttings back to the surface via the annulus between the drillstring and the wellbore wall.

Once a formation of interest is reached, drillers often investigate the formation and/or its contents through the use of downhole formation evaluation tools. Some example formation evaluation tools (e.g., LWD and MWD tools) may be part of the drillstring used to form the wellbore and may be used to evaluate formations during the drilling process. MWD typically refers to measuring the drill bit trajectory as well as wellbore temperature and pressure, while LWD refers to measuring formation and/or formation fluid parameters or properties, such as a resistivity, a porosity, a permeability, a viscosity, a density, a phase-change pressure, and a sonic velocity, among others. Real-time data, such as the formation pressure, allows decisions about drilling mud weight and composition to be made, as well as decisions about drilling rate and weight-on-bit (WOB) during the drilling process. While LWD and MWD have different meanings to those of ordinary skill in the art, that distinction is not germane to this disclosure, and therefore this disclosure does not distinguish between the two terms. Furthermore, LWD and MWD need not be performed while the drill bit is actually cutting through the formation F. For example, LWD and MWD may occur during interruptions in the drilling process, such as when the drill bit is briefly stopped to take measurements, after which drilling resumes. Measurements taken during intermittent breaks in drilling are still considered to be made while drilling because they do not require the drillstring to be removed from the wellbore or tripped.

Other example formation evaluation tools may be used after the wellbore has been drilled or formed and the drillstring removed from the wellbore. These tools may be lowered into a wellbore using a wireline for electronic communication and/or power transmission, and therefore are commonly referred to as wireline tools. In general, a wireline tool may be lowered into a wellbore to measure any number and/or type(s) of formation properties at any desired depth(s). Additionally or alternatively, a formation evaluation tool may be lowered into a wellbore via coiled tubing.

FIG. 1A depicts an example wireline system 100A according to one or more aspects of the present disclosure. The example wireline system 100A of FIG. 1A may be situated onshore (as shown) and/or offshore. The example wireline system 100A may include a wireline assembly 105, which may be configured to extract core samples from a subterranean formation F into which a wellbore 110 has been drilled.

The example wireline assembly 105 of FIG. 1A may be suspended from a rig 112 into the wellbore 110. The wireline assembly 105 may be suspended in the wellbore 110 at the lower end of a multi-conductor cable 115, which may be spooled on a winch (not shown) at the Earth's surface. At the surface, the cable 115 may be communicatively and/or electrically coupled to a control and data acquisition system 120. The example control and data acquisition system 120 of FIG. 1A may include a controller 125 having an interface configured to receive commands from a surface operator. The control and data acquisition system 120 may further include a processor 130 configured to control the extraction and/or storage of core samples by the example wireline assembly 105.

The example wireline assembly 105 of FIG. 1A may have an elongated body and/or housing 140 and may include a telemetry module 145 and/or a coring module 150. Although the example telemetry module 145 of FIG. 1A is shown as being implemented separate from the example coring module 150, the telemetry module 145 may alternatively be implemented by the coring module 150. Further, additional and/or alternative components, modules and/or tools may also be implemented by the wireline assembly 105.

The example coring module 150 of FIG. 1A may include a selectively pivotable coring apparatus 155 having a coring bit assembly 160. The example coring bit assembly 160 of FIG. 1A may be operated to obtain a core sample from the formation rock F. The coring module 150 may also includes a storage area 165 configured to store core samples taken from the formation F. The example storage area 165 of FIG. 1A may be configured to receive sample cores, which may or may not include a sleeve, canister, or other holder. A brace arm 170 may be provided to stabilize the wireline assembly 105 in the wellbore 110 when the coring bit assembly 160 is operating. The example brace arm 170 of FIG. 1A may be selectively controlled and/or positioned with a piston 175, which may be activated to engage the arm 170 against the surface of the wellbore 110 to stabilize the wireline assembly 105 within the wellbore 110. For example, the arm 170 may be extended until the side of the wireline assembly 105 having the coring bit assembly 160, which is opposite the example arm 170, engages the surface of the wellbore 110. Methods and apparatus to remove cores from the coring apparatus 155 and/or to place and/or arrange them in the example storage 165 are described in U.S. Patent Publication 2009/0114447, entitled "Coring Tool and Method," and published May 7, 2009.

The example coring bit assembly 160 of FIG. 1A may include a hollow drill bit, which is commonly referred to in the industry as a coring bit, that is advanced into the formation F so that material and/or a sample, which is commonly referred to in the industry as a core sample, may be removed from the formation F. A core sample may then be transported to the surface, where it may be analyzed to assess, among other things, the reservoir storage capacity (e.g., porosity) and permeability of the material that makes up the formation F; the chemical and mineral composition of the fluids and/or mineral deposits contained in the pores of the formation F; and/or the irreducible water content of the collected formation material. Among other things, the information obtained from analysis of a core sample may also be used to make formation exploitation and/or production decisions.

Downhole coring operations generally fall into two categories: axial and sidewall coring. Axial or conventional coring involves applying an axial force to advance a coring bit into the bottom of the wellbore 110. Typically, axial boring is carried out after a drillstring has been removed or tripped from the wellbore 110, and a rotary coring bit with a hollow interior for receiving the core sample is lowered into the wellbore 110 on the end of the drillstring.

By contrast, in sidewall coring the coring bit assembly 160 may be extended radially from the coring module 150 and may be advanced through the side wall of the wellbore 110 into the formation F. In sidewall coring, the drillstring typically cannot be used to rotate the coring bit assembly 160, nor can the drillstring provide the weight required to drive the bit into the formation F. Instead, the coring module 150 may generate both the torque that causes the rotary motion of the coring bit assembly 160 and the axial force or WOB necessary to drive the coring bit assembly 160 into the formation F. Another challenge of sidewall coring relates to the dimensional limitations of the borehole 110. The available space inside the wireline assembly 105 is limited by the diameter of the borehole 110. Within that diameter, there must be enough space to house the device(s) to operate the coring bit assembly 160 and enough space to withdraw and store a core sample.

According to one or more aspects of the present disclosure, the example coring module 150 is capable of obtaining core samples having larger lengths and/or larger diameters relative to conventional sidewall coring devices. Many wellbores 110 are formed with a diameter of approximately 6.5 to 17.5 inches. As a result, the overall diameter of the coring module 150 may be limited, which may also limit the length and/or diameter of the core samples that can be obtained from the formation F. The example coring module 150 described herein may be implemented within an overall diameter of less than approximately 5.25 inches. By using a selectively pivotable coring bit assembly 160 as described below, as opposed to sliding guide plates, the stroke length of the coring bit assembly 160 may be maximized for a given tool diameter. For example, the coring bit assembly 160 may be extended into the formation F by a distance of at least approximately 2.25 inches and more preferably up to approximately 3.0 inches in a coring module 150 having an overall diameter of less than approximately 5.25 inches. This larger core length is obtained by placing an example gear box 210 (FIG. 2) proximate to the cutting end of the coring bit assembly 160. By placing the example gear box 210 proximate to the cutting end, the coring bit assembly 160 may be extended into the formation F by substantially the overall length of the coring bit assembly 160.

Additionally, the example coring bit assembly 160 may be implemented with an inner diameter of at least approximately 1.0 inches and, more preferably, approximately 1.5 inches. This larger core diameter is obtained by rotating the coring bit assembly 160 via the gear box 210 (FIG. 2) rather than via a direct-drive motor operably coupled to or implemented around an interior end of the coring bit assembly 160. Such conventional direct-drive devices require large diameter drive mechanisms that may limit the diameter of the coring bit assembly 160. Moreover, such conventional implementations require the coring motor to move together with the coring bit as the coring bit extends into the formation. In contrast, the example gear box 210 drives the coring bit assembly 160 using a motor 205 and pinion 405 (FIG. 4B) that may be substantially smaller than the diameter of the coring bit assembly 160. Further, by reducing the dimensions of the coring motor 210 it may be made more energy efficient. For example, the coring module 150 may be implemented to consume as little as 2 kW of power. Further still, the example coring motor 205 and the gear box 210 need not move as the coring bit assembly 160 extends into the formation F.

A large volume core may be advantageous for the evaluation of the formation F. For example, one of the tests that may be performed on sample core is a flow test. This test may provide porosity and/or permeability values of the formation F from which the core has been obtained. These values are often used together with other formation evaluation data to estimate the amount of hydrocarbon that can potentially be produced from the wellbore 110. However, it should be appreciated that the accuracy of the flow test result is usually sensitive to the volume of the core sample. The core samples that may be collected by the example coring module 150 may have a length of up to approximately 3.0 inches, which is an increase of greater than 50 percent over the core samples obtainable using conventional sidewall coring tools, thereby yielding a substantially increased testable volume even after the ends of the core samples are trimmed By doing so, the results of analyses performed on the core samples may be more accurate, thereby providing better estimates of the hydrocarbon reserves.

Additionally, collecting core samples having diameters of approximately 1.5 inches, which is an increase of about 50 percent over the cores obtainable using conventional sidewall coring tools, may further increase the core volume by 125 percent. Further, laboratory equipment is typically designed for 1.5 and 2.0 inch diameter cores and, more rarely, for 1.0 inch cores. Thus, core samples obtained using conventional sidewall coring tools may require wrapping or padding in order to properly fit these core samples into testers designed for larger diameter cores. In contrast, core samples obtained by the example sidewall coring module 150 may be tested using readily available laboratory equipment without having to apply such wrapping or padding.

Conventional sidewall coring tools face several challenges. To store multiple core samples, the coring bit is often pivotably mounted within the tool so that it can move between a coring position, in which the bit is positioned to engage the formation, and an eject position, in which a core sample may be ejected from the bit into a core sample receptacle. However, the conventional mechanisms for actuating the coring bit are relatively complicated and sensitive to the rough environments in which they are used. For example, U.S. Pat. No. 5,439,065 to Georgi describes a sidewall coring apparatus having a bit box with hinge pins that are received in guide slots formed in plates. The guide slots are shaped to both rotate the coring bit and to extend the coring bit into the formation. However, the slots described by Georgi are susceptible to obstruction from solid material such as rocks or other debris that may enter the tool, and the WOB will vary as the bit is extended into the formation. Additionally, conventional sidewall coring tools may have limited storage area for core samples. Still further, conventional coring tools may not reliably break the core samples away from the formation. The example methods and apparatus disclosed herein overcome at least these deficiencies of the above mentioned conventional sidewall coring tools.

The examples described herein may provide any number of additional and/or alternative advantages. For example, because the coring motor 205 and the gear box 210 rotate together with a coring tool housing 320 (FIG. 3A) and the coring bit assembly 160, the example apparatus and methods described herein can obtain core samples at angles other than perpendicular to an axis 315 of the coring module 150. Further, because rotation of the coring tool housing 320, the coring bit assembly 160, the coring motor 205 and the gear box 210 may be controlled separately from the extension of the coring bit assembly 160 into the formation F, core samples of different lengths may be obtained.

While not shown in FIG. 1A, the example wireline assembly 105 of FIG. 1A may implement any number and/or type (s) of alternative and/or additional modules and/or tools.

Other example modules and/or tools that may be implemented by the wireline assembly 105 include, but are not limited to, a formation testing tool, a power module, a hydraulic module, and/or a fluid analyzer module. Some example formation evaluation tools draw fluid(s) from the formation F into the wireline assembly 105. As fluid(s) are drawn into the wireline assembly 105, various measurements of the fluid(s) may be performed to determine any number and/or type(s) of formation property(-ies) and condition(s), such as the fluid pressure in the formation F, the permeability of the formation F and/or the bubble point of the formation fluid(s). These and other properties may be important in making formation exploration decisions and/or evaluations. In this disclosure, the term formation testing tool encompasses any downhole tool that draws fluid(s) from the formation F into the wireline assembly 105 for evaluation, whether or not the samples are stored. In cases where fluid(s) are captured, sometimes referred to as fluid sampling, fluid(s) may be drawn into a sample chamber and transported to the surface for further analysis (often at a laboratory).

The example telemetry module 145 of FIG. 1A may comprise a downhole control system (not shown) communicatively coupled to the example control and data acquisition system 120. In the illustrated example of FIG. 1A, the control and data acquisition system 120 and/or the downhole control system may be configured to control the coring module 150.

As depicted in FIG. 1A, the example wireline assembly 105 may include multiple downhole modules and/or tools that are operatively connected together. Downhole tool assemblies often include several modules (e.g., sections of the wireline assembly 105 that perform different functions). Additionally, more than one downhole tool or component may be combined on the same wireline to accomplish multiple downhole tasks during the same wireline run. The modules are typically connected by field joints. For example, each module of a wireline assembly typically has one type of connector at its top end and a second type of connector at its bottom end. The top and bottom connectors are made to operatively mate with each other. By using modules and/or tools with similar arrangements of connectors, all of the modules and tools may be connected end-to-end to form the wireline assembly 105. A field joint may provide an electrical connection, a hydraulic connection, and/or a flowline connection, depending on the requirements of the tools on the wireline. An electrical connection typically provides both power and communication capabilities.

In practice, the wireline tool assembly 105 may include several different components, some of which may include two or more modules (e.g., a sample module and a pumpout module of a formation testing tool). In this disclosure, the term "module" is used to describe any of the separate and/or individual tool modules that may be connected to implement the wireline assembly 105. The term "module" refers to any part of the wireline assembly 105, whether the module is part of a larger tool or a separate tool by itself. It is also noted that the term "wireline tool" is sometimes used in the art to describe the entire wireline assembly 105, including all of the individual tools that make up the assembly. In this disclosure, the term "wireline assembly" is used to prevent any confusion with the individual tools that make up the wireline assembly (e.g., a coring module, a formation testing tool, and a nuclear magnetic resonance (NMR) tool may all be included in a single wireline assembly).

Figure 1B:
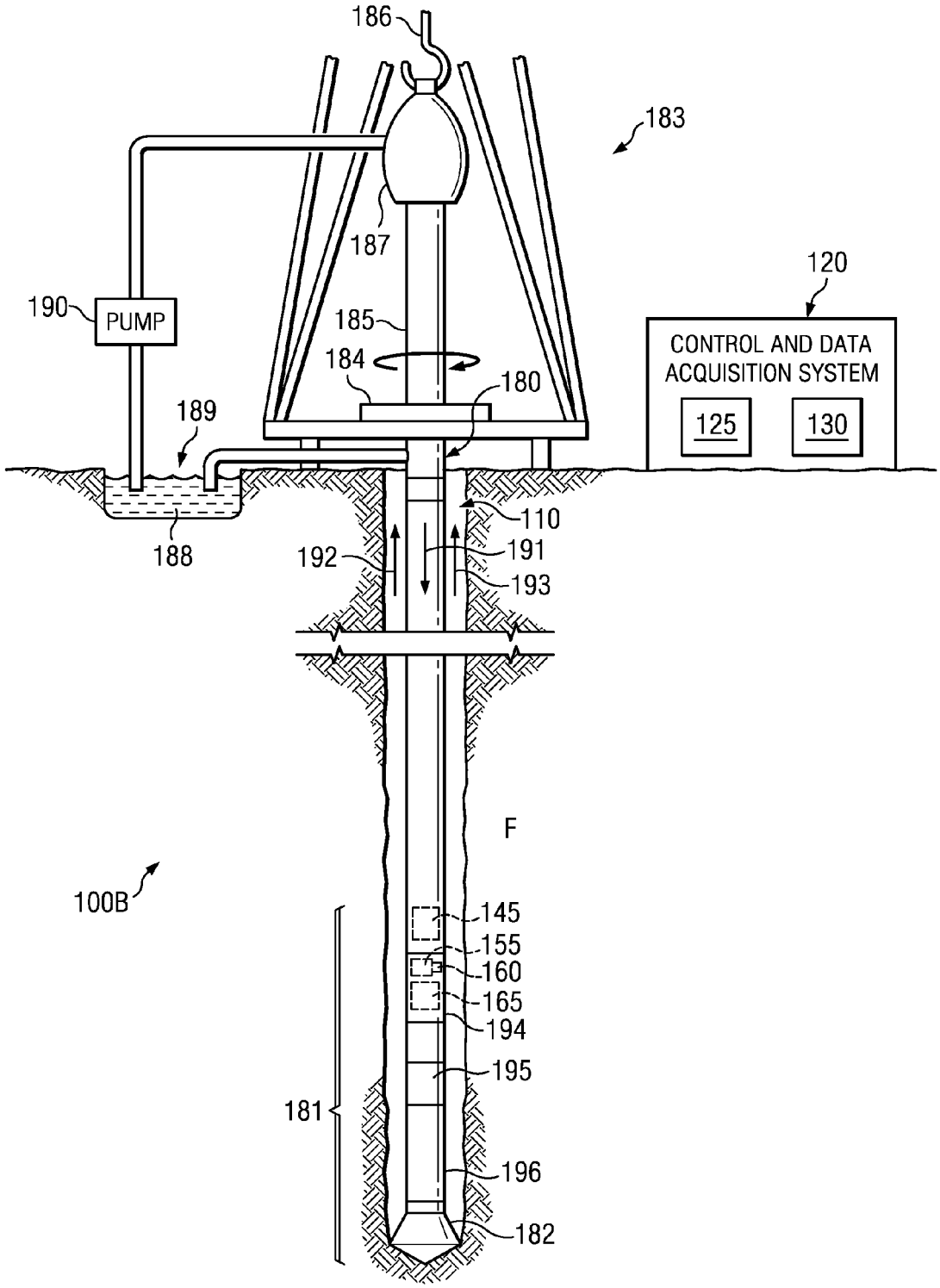
FIG. 1B is a schematic of a wellsite drilling system according to one or more aspects of the present disclosure.

FIG. 1B depicts an example wellsite drilling system 100B according to one or more aspects of the present disclosure, which may be employed onshore (as shown) and/or offshore. In the example wellsite system 100B of FIG. 1B, the example borehole 110 is formed in the subsurface formation F by rotary and/or directional drilling. In the illustrated example of FIG. 1B, a drillstring 180 is suspended within the example borehole 110 and has a bottom hole assembly (BHA) 181 having a drill bit 182 at its lower end. A surface system includes a platform and derrick assembly 183 positioned over the borehole 110. The assembly 183 may include a rotary table 184, a kelly 185, a hook 186 and/or a rotary swivel 187. The drillstring 180 may be rotated by the rotary table 184, energized by means not shown, which engages the kelly 185 at the upper end of the drillstring 180. The example drillstring 180 may be suspended from the hook 186, which may be attached to a traveling block (not shown) and through the kelly 185 and the rotary swivel 187, which permits rotation of the drillstring 180 relative to the hook 186. Additionally or alternatively, a top drive system may be used.

In the example of FIG. 1B, the surface system 100B may also include drilling fluid 188, which is commonly referred to in the industry as mud, stored in a pit 189 formed at the wellsite. A pump 190 may deliver the drilling fluid 188 to the interior of the drillstring 180 via a port (not shown) in the swivel 187, causing the drilling fluid 188 to flow downwardly through the drillstring 180 as indicated by the directional arrow 191. The drilling fluid 188 may exit the drillstring 180 via water courses, nozzles, jets and/or ports in the drill bit 182, and then circulate upwardly through the annulus region between the outside of the drillstring 180 and the wall of the wellbore 110, as indicated by the directional arrows 192 and 193. The drilling fluid 188 may be used to lubricate the drill bit 182 and/or carry formation cuttings up to the surface, where the drilling fluid 188 may be cleaned and returned to the pit 189 for recirculation. The drilling fluid 188 may also be used to create a mudcake layer (not shown) on the walls of the wellbore 110. It should be noted that in some implementations, the drill bit 182 may be omitted and the bottom hole assembly 181 may be conveyed via coiled tubing and/or pipe.

The example BHA 181 of FIG. 1B may include, among other things, any number and/or type(s) of while-drilling downhole tools, such as any number and/or type(s) of LWD modules (one of which is designated at reference numeral 194), and/or any number and/or type(s) of MWD modules (one of which is designated at reference numeral 195), a rotary-steerable system or mud motor 196, and/or the example drill bit 182.

The example LWD module 194 of FIG. 1B is housed in a special type of drill collar, as it is known in the art, and may contain any number and/or type(s) of logging tool(s), measurement tool(s), sensor(s), device(s), formation evaluation tool(s), fluid analysis tool(s), and/or fluid sampling device(s). The example LWD module 194 of FIG. 1B may implement the example coring module 150 described above in connection with FIG. 1A. Accordingly, the example LWD module 194 may implement, among other things, the example coring assembly 155, the example coring bit assembly 160, and/or the example storage area 165, as shown in FIG. 1B. The same or different LWD modules may implement capabilities for measuring, processing, and/or storing information, as well as the example telemetry module 145 for communicating with the MWD module 195 and/or directly with surface equipment, such as the example control and data acquisition system 120. While a single LWD module 194 is depicted in FIG. 1B, it will also be understood that more than one LWD module may be implemented.

The example MWD module 195 of FIG. 1B is also housed in a special type of drill collar and contains one or more devices for measuring characteristics of the drillstring 180 and/or the drill bit 182. The example MWD tool 195 may also include an apparatus (not shown) for generating electrical power for use by the downhole system 181. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick/slip measuring device, a direction measuring device, and an inclination measuring device. Additionally or alternatively, the MWD module 195 may include an annular pressure sensor, and/or a natural gamma ray sensor. The MWD module 195 may also include capabilities for measuring, processing, and storing information, as well as for communicating with the control and data acquisition system 120. For example, the MWD module 195 and the control and data acquisition system 120 may communicate information either way (i.e., uplink and downlink) using any past, present or future two-way telemetry system such as a mud-pulse telemetry system, a wired drillpipe telemetry system, an electromagnetic telemetry system and/or an acoustic telemetry system. As shown in FIG. 1B, the example control and data acquisition system 120 of FIG. 1B may also include the example controller 125 and/or the example processor 130 discussed above in connection with FIG. 1A.

Figure 2:
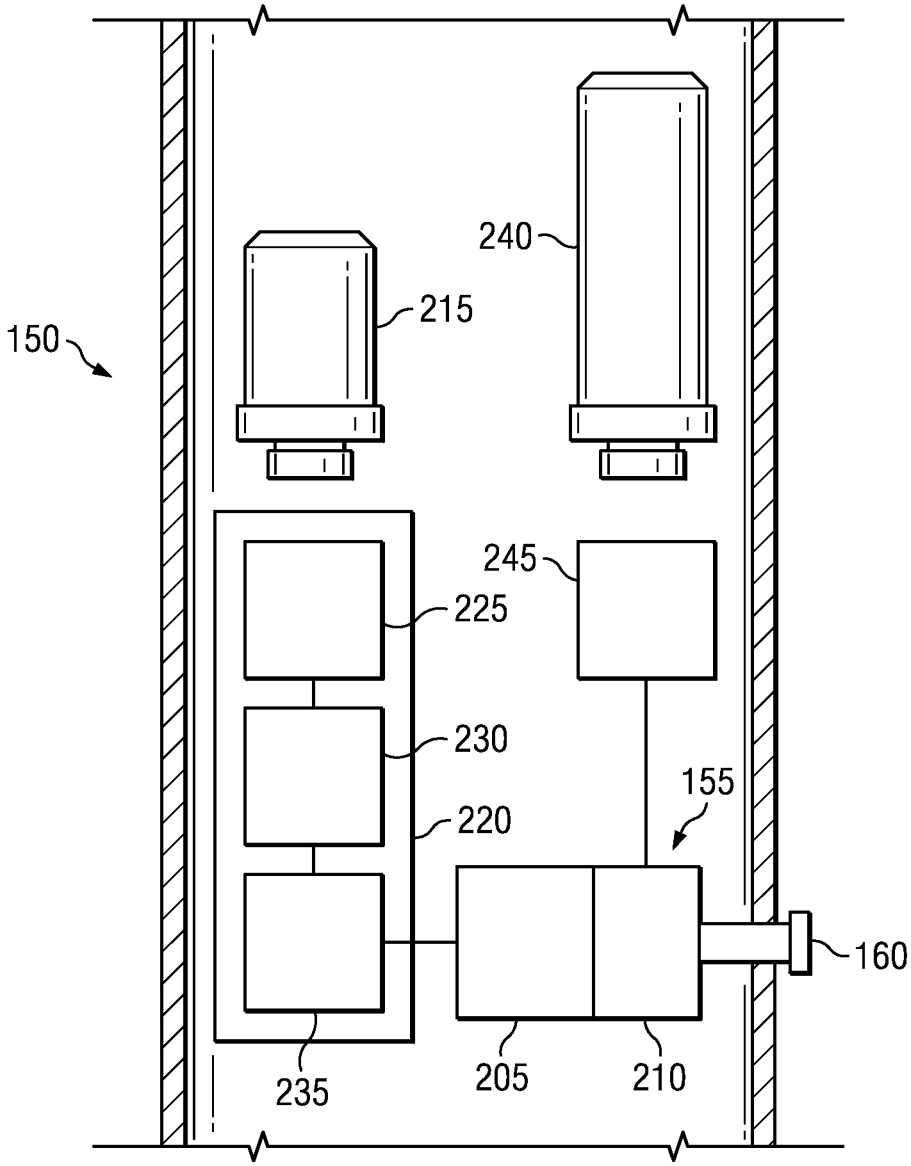
FIG. 2 is a schematic depiction of a coring module according to one or more aspects of the present disclosure.

FIG. 2 is a schematic illustration of the example coring module 150 according to one or more aspects of the present disclosure. As noted above, the coring module 150 may include the coring apparatus 155 having the coring bit assembly 160. The example coring module 150 may also include a hydraulic coring motor 205, which may be operatively coupled to the coring bit assembly 160 via a gear box 210, to rotationally drive the coring bit assembly 160 so that the coring bit assembly 160 may cut into the formation F and obtain a core sample.

To drive the coring bit assembly 160 into the formation, the coring bit assembly 160 may be pressed into the formation F while it is rotated. Thus, the coring module 150 may apply a WOB force that presses the coring bit assembly 160 into the formation F and may apply a torque to the coring bit assembly 160. FIG. 2 schematically depicts mechanisms for applying both of these forces. For example, the WOB may be generated by a motor 215, which may be an AC, brushless DC, or other power source, and a control assembly 220. The example control assembly 220 of FIG. 2 may include a hydraulic pump 225, a feedback flow control (FFC) valve 230, and a piston 235. The motor 215 supplies power to the hydraulic pump 225, while the flow of hydraulic fluid from the pump 225 is regulated by the FFC valve 230. The pressure of the hydraulic fluid drives the piston 235 to apply a WOB to the coring bit assembly 160, as described in greater detail below.

The torque may be supplied by another motor 240, which may be an AC, brushless DC, or other power source, and a gear pump 245. The second motor 240 drives the gear pump 245, which supplies a flow of hydraulic fluid to the hydraulic coring motor 205. The hydraulic coring motor 205, in turn, imparts a torque or rotational force to the coring bit assembly 160 via the gear box 210.

While example apparatus and methods for applying WOB and torque to the coring bit assembly 160 are shown in FIG. 2, any additional and/or alternative mechanisms for generating and/or applying such forces may be used without departing from the scope of this disclosure. Additional examples of mechanisms that may be used to generate and/or apply WOB and torque are disclosed in U.S. Pat. No. 6,371,221, entitled "Coring Bit Motor and Method For Obtaining a Material Core Sample," granted Apr. 16, 2002; and U.S. Pat. No. 7,191,831, entitled "Downhole Formation Testing Tool," and granted Mar. 20, 2007, both of which are assigned to the assignee of the present application and both of which are incorporated herein by reference in their entireties.

Figure 3A:
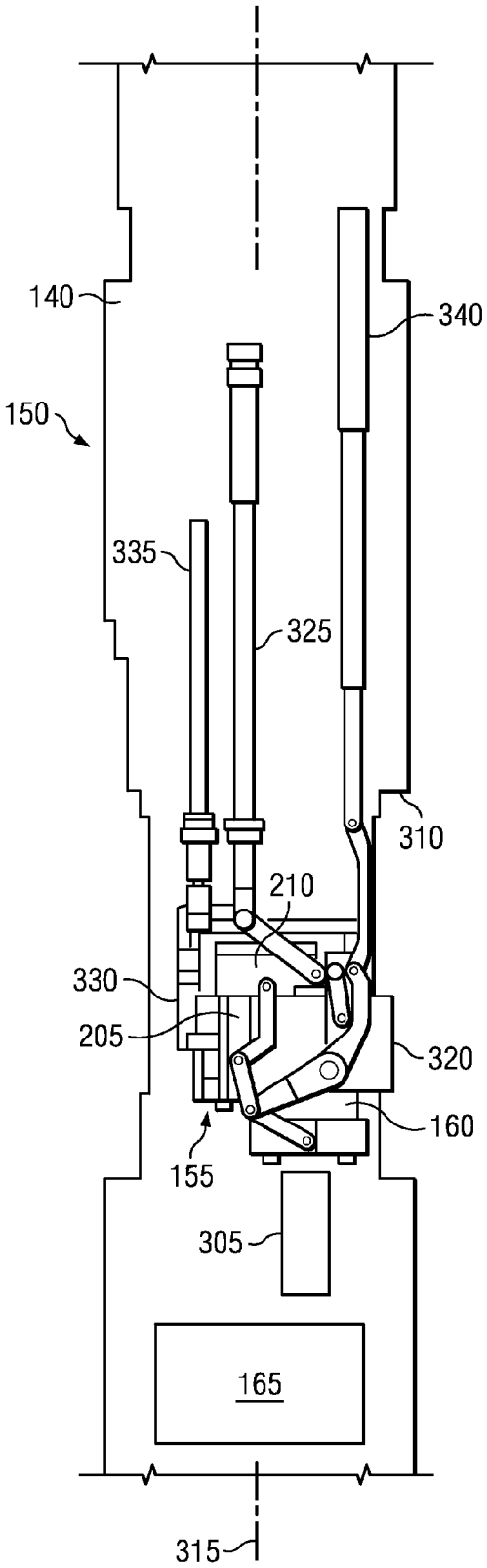
FIGS. 3A-D depict a coring module according to one or more aspects of the present disclosure.
Figure 3B:
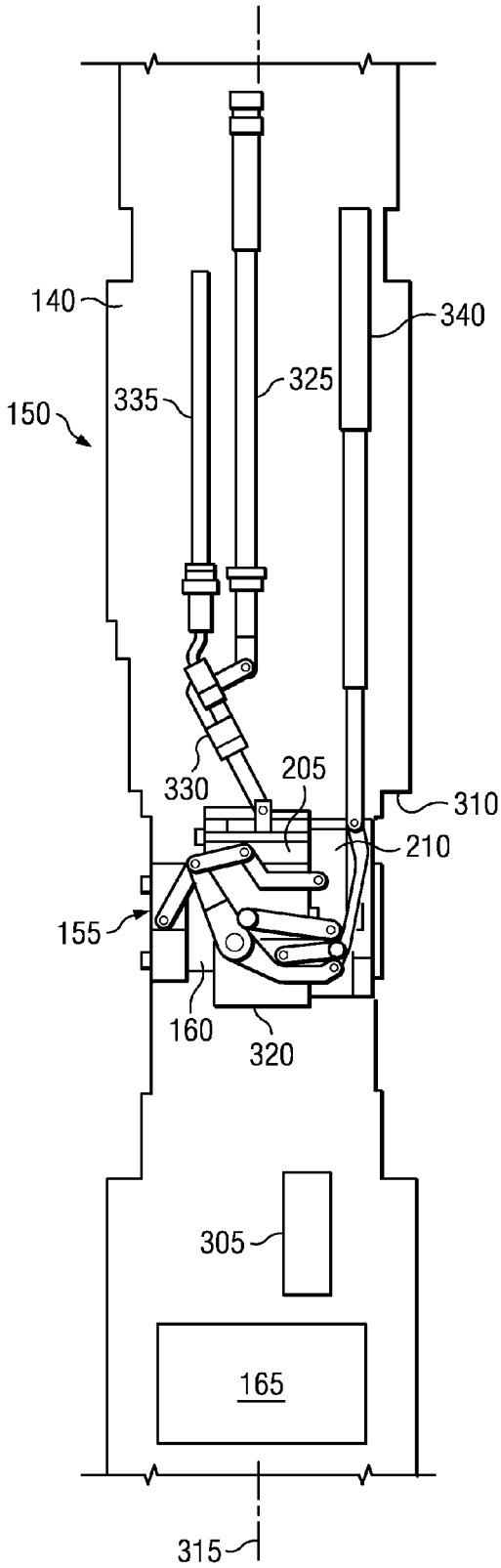
Figure 3C:
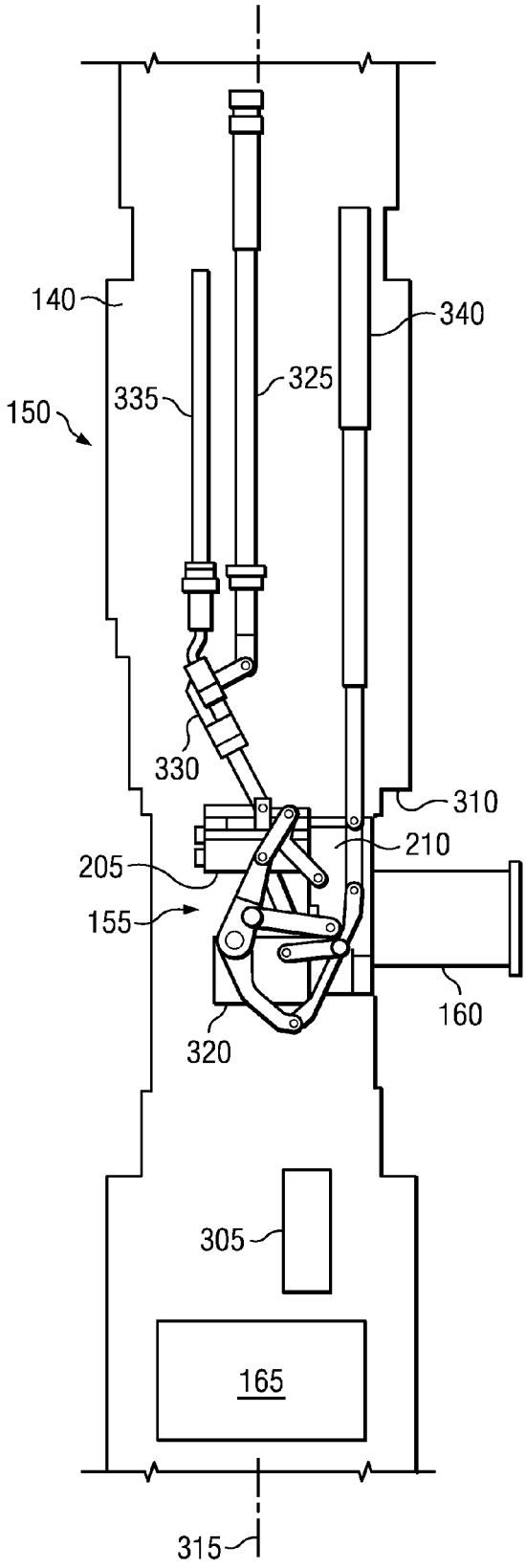
Figure 3D:
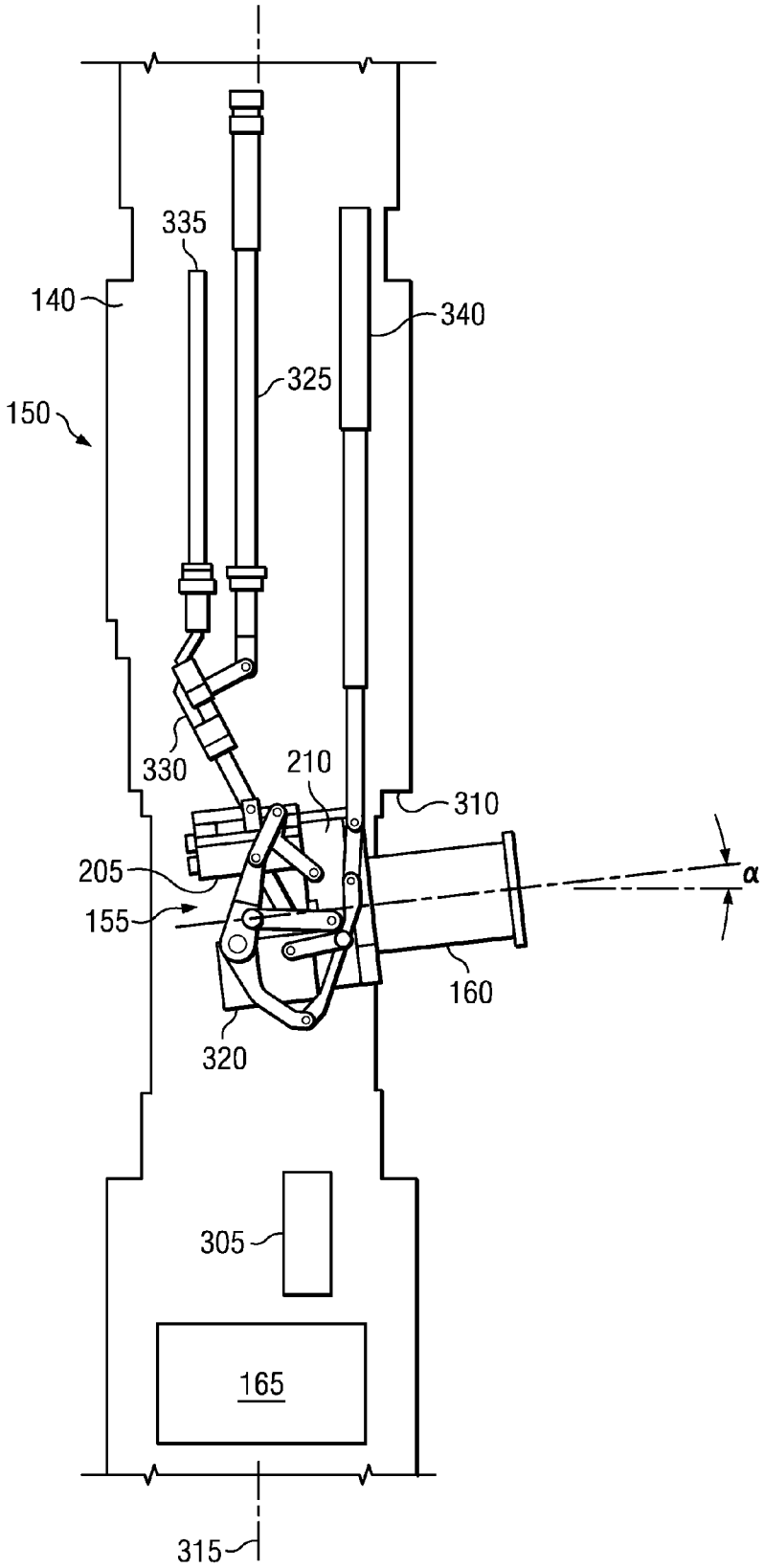

Details of the example coring module 150 and the example coring apparatus 155 of FIGS. 1 and 2 are depicted in FIGS. 3A-D and in FIGS. 4A-D, respectively. However, for ease of understanding, FIGS. 3A-D and 4A-D will be described together. Accordingly, identical elements in FIGS. 3A-D and 4A-D are designated with identical reference numerals. FIGS. 3A-D illustrate an example manner of implementing and/or operating the example coring module 150 to collect a core sample from the example formation F. FIG. 3A depicts the example coring module 150 in an initial, eject or storage position where the coring bit assembly 160 is fully retracted. In the example position of FIG. 3A, a core sample 305 may be removed from the coring module 150 and/or the wireline assembly 105 may be moved and/or positioned within the wellbore 110. FIG. 3B depicts the example coring module 150 rotated 90 degrees into a position to allow the coring bit assembly 160 to be radially extendable through an opening 310 of the example housing 140. FIG. 3C depicts the example coring module 150 with the coring bit assembly 160 extended into the formation F. FIG. 3D depicts the example coring module 150 with the coring bit assembly 160 extended and the coring module 150 additionally rotated to snap, severe and/or otherwise disconnect the core sample from the formation F.

Figure 4A:
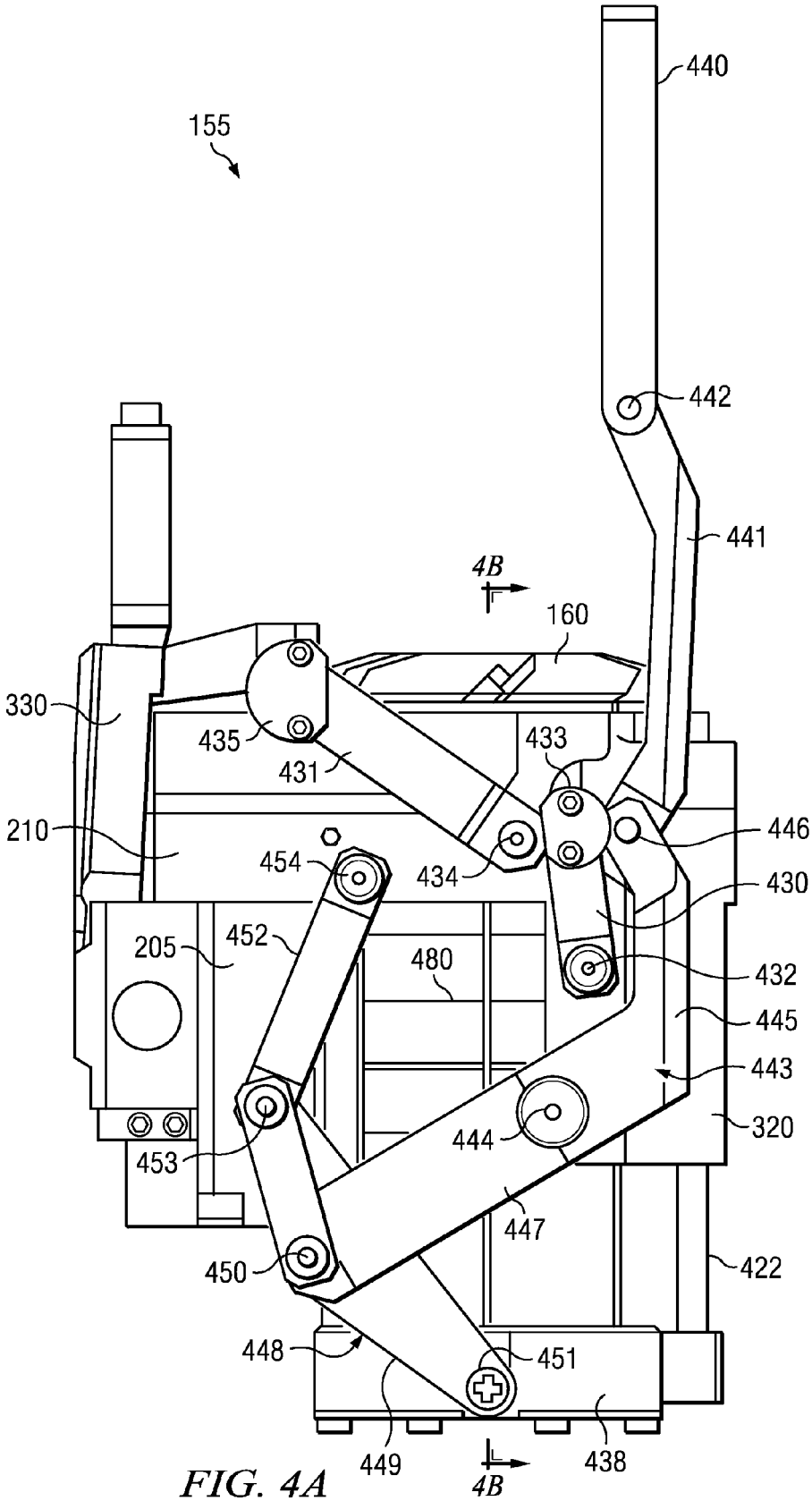
FIGS. 4A-D depict a coring apparatus according to one or more aspects of the present disclosure.
Figure 4B:
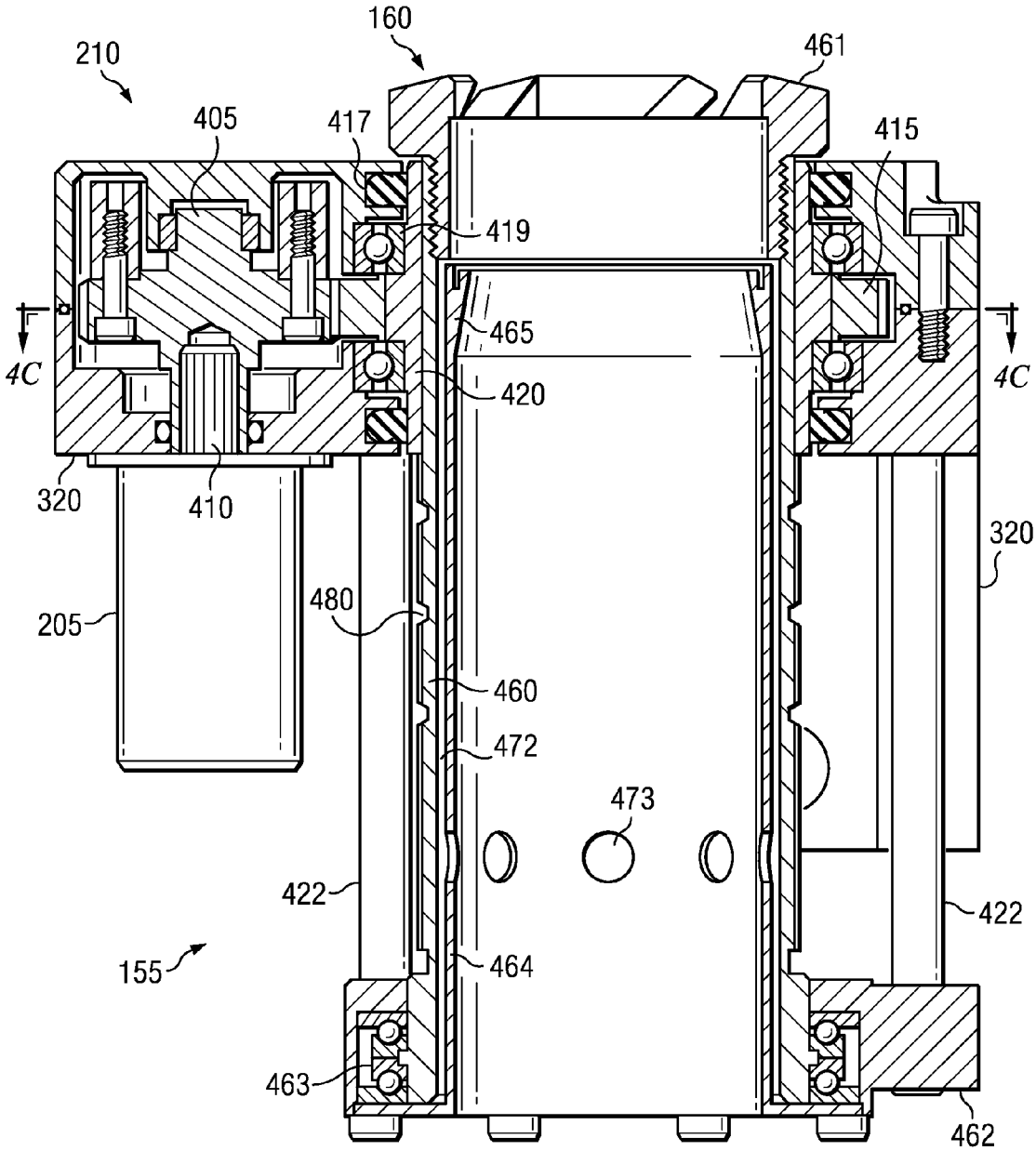
Figure 4C:
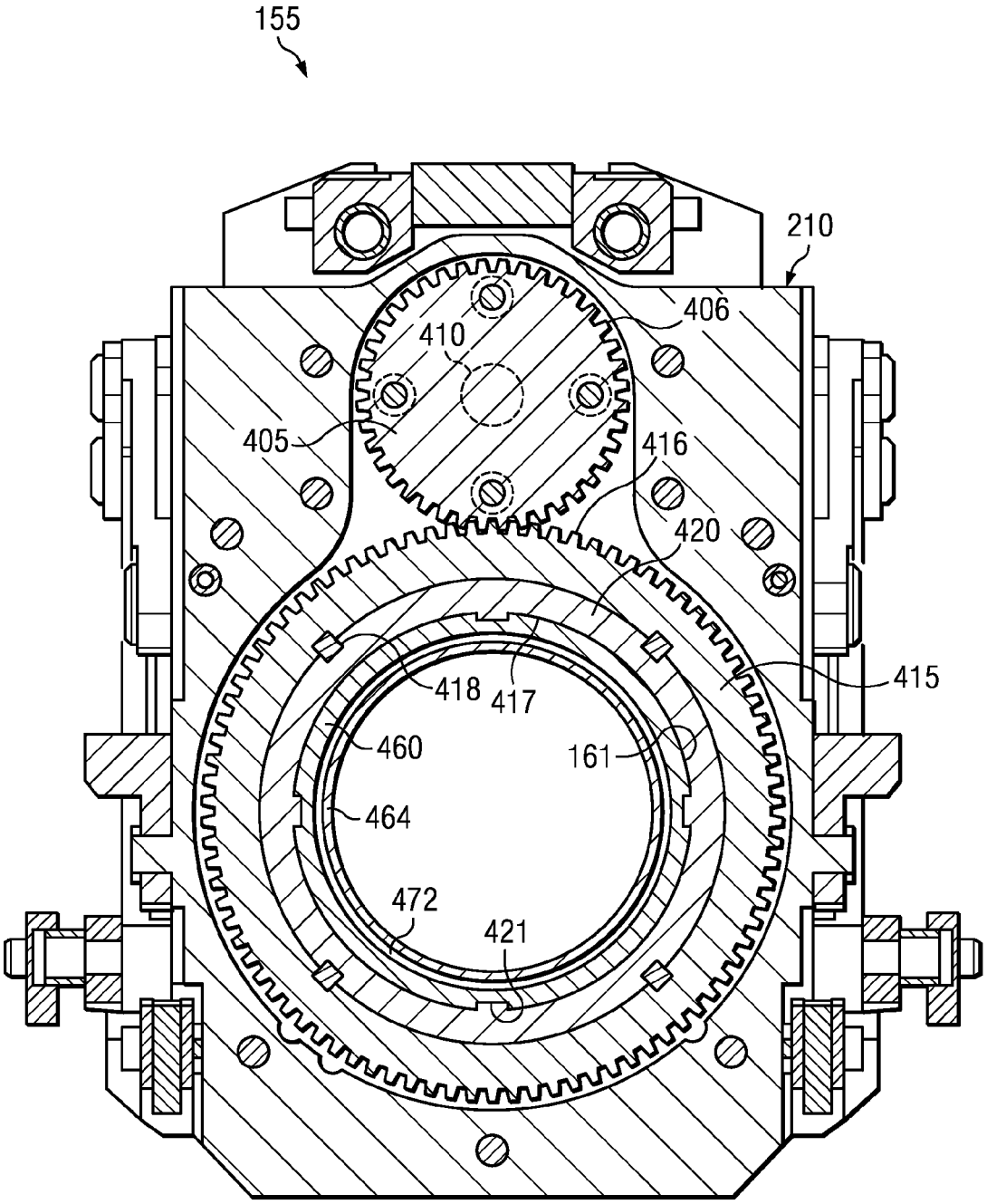
Figure 4D:
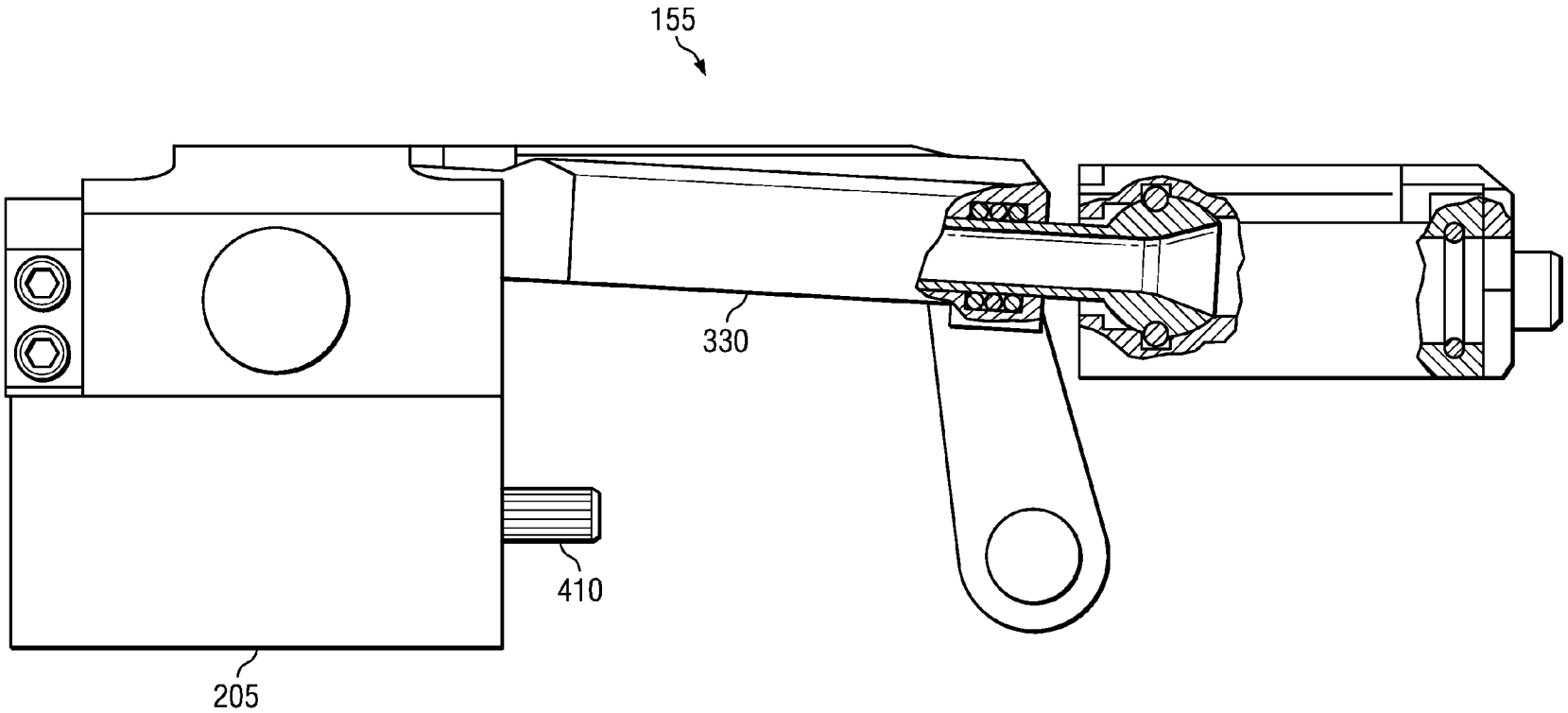

FIGS. 4A-D depict various views of the example coring apparatus 155 of FIGS. 1, 2 and 3A-D. FIG. 4A depicts a side view of the coring apparatus 155 in the orientation of FIG. 3A. FIG. 4B depicts a top cross-sectional view of the example coring apparatus 155 taken along line 4B-4B of FIG. 4A. FIG. 4C depicts an end cross-sectional view of the example coring apparatus 155 taken along line 4C-4C of FIG. 4B. FIG. 4D depicts a partial cut-away view of the example intermediate link arm 330 of FIG. 4A.

As shown in FIGS. 3A-D, the example coring module 150 is implemented in the example module housing 140, which extends longitudinally along the axis 315. The example tool housing 140 of FIGS. 3A-D defines the example coring aperture 310 through which core samples may be retrieved. The example storage area 165 may also be disposed within the tool housing 140.

The example coring apparatus 155 may include the example coring tool housing 320. The coring apparatus 155 together with the example coring tool housing 320 may be selectively rotated with respect to the housing 140, as shown in FIGS. 3A-D. The coring bit assembly 160 is mounted within the coring tool housing 320 and may be longitudinally or slidably positioned in the coring tool housing 320 and may be rotated within the coring tool housing 320. In other words, the coring bit assembly 160 may both slide longitudinally and rotate within the coring tool housing 320.

The example coring motor 205 is also mounted on the coring tool housing 320 and is operably connected to the coring bit assembly 160 to rotate the coring bit assembly 160 via the example gear box 210. As best seen in FIGS. 4B and 4C, the example gear box 210 may include the example pinion 405, which is operably connected to a drive shaft 410 of the coring motor 210. The example drive shaft 410 may be fluted to correspond with a fluted socket of the pinion 405. The example pinion 405 rotates in response to rotation of the example drive shaft 410 of the coring motor 210. An outer geared surface 406 (FIG. 4C) of the example pinion 405 engages an outer geared surface 416 of a gear drive 415 to rotate the gear drive 415 in response to rotation of the coring motor 210. A key member 420 of the gear box 215 engages an inner surface 417 of the example gear drive 415 and an outer surface 161 of the example coring bit assembly 160 to rotate a coring bit shaft 160 of the coring bit assembly 160 in response to rotation of the example pinion 405. The example key member 420 and the example inner surface 417 of the gear drive 415 may have corresponding or matching key ways into which keys, one of which is designated at reference numeral 418, may be inserted to engage the key member 420 and the inner surface 417. The example key member 420 may have protrusions, one of which is designated at reference numeral 421 that engage respective longitudinal slots on the outer surface 161 of the coring bit shaft 460.

The example gear drive 415 may be rotationally coupled to the coring tool housing 320 via ball bearings, one of which is designated at reference numeral 419 (FIG. 4B). As illustrated in FIG. 4B one or more seals 417 may be implemented to prevent fluid from seeping or infiltrating the gear box 210. While the example coring motor 205 discussed herein is a hydraulic motor, it will be appreciated that any number and/or type(s) of motor(s) and/or mechanism(s) capable of rotating the pinion 405 and/or the drive shaft 410 may be used. An example hydraulic coring motor 205 is described in U.S. Pat. No. 3,680,989, entitled "Hydraulic Pump or Motor," and granted Aug. 1, 1972, which is hereby incorporated by reference in its entirety.

The example key member 420 may engage the outer surface 161 of the example coring shaft 460 along the length of the coring shaft 460. Thus, as the coring shaft 460 is rotated and moves into the formation F, the coring motor 205 continues to rotate the coring shaft 460 via the gear box 215 and the key member 420. Because the example gear box 215 is implemented proximate to cutting elements 461 (FIG. 4B) of the coring bit assembly 160, the example coring bit assembly 160 may be extended into the formation F a distance substantially equal to the length of the coring bit assembly 160. As best shown in FIGS. 3A-D, the coring motor 205 and the gear box 215 rotate with the example coring bit assembly 160. Because the coring motor 205, the gear box 215 and the coring bit assembly 160 rotate together, the example methods and apparatus described herein may be used to obtain core samples at various angles with respect to the axis 315.

The example coring tool housing 320 may include one or more (e.g., four) alignment rods, one of which is designated at reference numeral 422. As best shown in FIG. 4B, the coring tool housing 320 may include a thrust ring 462 configured to slide along the alignment rods 422. The example thrust ring 462 may include thrust bearings, one of which is designated at reference numeral 463, that are configured to permit rotation of the coring bit assembly 160 within the coring tool housing 320. A sleeve 464 may be secured to the thrust ring 462 and move longitudinally in unison with the coring bit assembly 160.

One or more rotation link arms are provided for selectively rotating the coring apparatus 155 with respect to the housing 140. As best seen in FIG. 4A, the example coring apparatus 155 includes a first pair of rotation link arms 430 and a second pair of rotation link arms 431. Another set of link arms 430 and 431 is disposed on the other side of the coring apparatus 155. Each rotation link arm 430 includes a first end 432 pivotably coupled to the coring tool housing 320 and a second end 433 pivotably coupled to the tool housing 140. Similarly, each rotation link arm 431 includes a first end 434 pivotably coupled to the coring tool housing 320 and a second end 435 pivotably coupled to the housing 140. As used herein, the terms "pivotably coupled" and "pivotably connected" mean a connection between two tool components that allows relative rotation or pivoting movement of one of the components with respect to the other component, but does not allow sliding or translational movement of the one component with respect to the other.

The example rotation link arms 430, 431 are positioned and/or configured to allow the example coring tool housing 320 to rotate with respect to the housing 140 from an eject position in which the coring bit assembly 160 is oriented substantially parallel to the tool housing longitudinal axis 152 as shown in FIG. 3A, and a coring position in which the coring tool housing 320 is rotated so that the coring bit assembly 160 may extend radially as shown in FIGS. 3B-D. When the coring tool housing 320 is in the example eject position of FIG. 3A, a core cavity of the coring bit assembly 160 registers and/or aligns with the storage area 165. Conversely, when the coring tool housing 320 is in the example coring position shown in FIG. 3B, the core cavity of the coring bit assembly 160 registers and/or aligns with the coring aperture 310 formed in the housing 140. The term "register" is used herein to indicate that voids or spaces defined by two components (such as the core cavity of the coring bit assembly 160 and the storage area 165 or coring aperture 310) are substantially aligned.

A first or rotation piston 325 is operably coupled to the coring tool housing 320 to rotate the coring tool housing 320 between the eject and coring positions. As shown in FIGS. 3A-D, the rotation piston 325 is coupled to the coring tool housing 320 by an intermediate link arm 330. As the piston 325 moves from an extended position shown in FIG. 3A to a retracted position shown in FIG. 3B, the coring tool housing 320 rotates about the rotation link arms 430, 431 from the eject position to the coring position. The example intermediate link arm 330 may also be used to communicate hydraulic fluid from one or more hydraulic flow lines 335 to the coring motor 130, as shown in the example partial cutaway view of FIG. 4D.

A series of pivotably coupled extension link arms is coupled to a portion of the coring tool housing 320 such as the thrust ring 462 to provide a substantially constant WOB. An example series of extension link arms includes a yoke 440 operably coupled to a second or extension piston 340. A pair of followers 441 is pivotably coupled to the yoke 440 at pins 442. A pair of rocker arms 443 is pivotably mounted on the coring tool housing 320 for rotation about an associated pin 444. Each of the example rocker arms 443 is mounted on a respective opposite side of the coring tool housing 320. Each rocker arm 443 includes a first segment 445 that is pivotably coupled to its associated follower link arm 441 at pin 446 and a second segment 447. A scissor jack 448 is pivotably coupled to each rocker arm 443. Each of the example scissor jacks 448 includes a bit arm 449 pivotably coupled to the rocker arm second segment 447 at pin 450 and further pivotably coupled to the thrust ring 462 of the coring bit assembly 160 at pin 451. Each scissor jack 448 further includes a housing arm 452 having a first end pivotably coupled to the bit arm 449 at pin 453 and a second end pivotably coupled to the coring tool housing 320 at pin 454. In the illustrated embodiment, the series of link arms includes the yoke 440, followers 441, rocker arms 443 and scissor jacks 448. However, the series of example extension link arms may include additional or fewer components that are pivotably coupled to one another without departing from the scope of this disclosure and the appended claims.

With the series of extension link arms as shown, movement of the second or extension piston 340 actuates the coring apparatus 155 and hence the coring bit assembly 160 between a retracted position as shown in FIG. 3B and an extended position as shown in FIG. 3C. The extension piston 340 may begin in a retracted position as shown in FIG. 3B. As the second piston 340 moves toward the extended position shown in FIG. 3C, it pushes the yoke 440 and follower link arm 441 to rotate the rocker arm 443 in a clockwise direction for the example tool housing orientation shown in FIGS. 3C and 3D. When the rocker arm 443 rotates clockwise, it closes the scissor jack 448, thereby driving the coring apparatus 155 to the extended position of FIG. 3C. By locating the pins 451, 453 as shown in FIG. 4A, the scissor jacks 448 exert a mechanical advantage as the scissor jacks 448 close. More specifically, the amount of lost motion in the series of extension link arms is kept essentially constant as the scissor jacks close, transferring an almost constant percentage of the piston force to the coring bit assembly 160. As a result, the series of extension link arms produces a substantially constant WOB across the entire range of travel of the coring bit assembly 160.

From the foregoing, it should be appreciated that extension of the coring bit assembly 160 may be substantially operatively decoupled from the rotation of the coring tool housing 320. The first piston 325 and intermediate link arm 330 are independent from the second piston 340 and series of extension link arms used to extend the coring bit assembly 160. Accordingly, the first and second pistons 325 and 340 may be operated substantially independent of one another, which may allow for additional and improved functionality of the coring module 150. For example, notwithstanding any clearance issues with the tool housing 140 or other tool structures, the coring bit assembly 160 may be extended at any time regardless of the rotational or angular position of the coring tool housing 320. Consequently, core samples may be obtained along a diagonal plane when the coring tool housing 320 is held at an orientation somewhere between the eject and coring positions described above. Further, the coring bit assembly 160 need not be fully extended into the formation F. For example, a shorter core sample may be extracted when further drilling into the formation F is deemed difficult or inefficient and a shorter core sample is nevertheless desirable and/or acceptable.

While the first and second pistons 325 and 340 may be operated independently, operation of one of the pistons 325, 340 may impact or otherwise require cooperation of the other piston 325, 340. During rotation of the coring tool housing 320, for example, the second piston 340 may be de-energized or controlled in a manner such as by dithering, to minimize any resistance the second piston 340 might exert against such rotation. However, the primary functions of the rotation link arms and the extension link arms may be achieved independent of one another.

The rotation link arms 430 and 431 may further permit additional rotation of the coring tool housing 320 to a separate or sever position shown in FIG. 3D to assist with separating a core sample from the formation F. When cutting into the formation F by the coring bit assembly 160 is complete, the core sample formed by the coring bit assembly 160 may still remain attached to the formation F. To assist with detaching the core sample, the coring tool housing 320 may be further rotated by an additional amount to the sever position as shown in FIG. 3D. It has been found that an additional angular rotation a of approximately 7 degrees is typically sufficient to sever the core sample from the formation F. However, the required additional angular rotation may be approximately 0.25 to 2 degrees. The first and second rotation link arms 430 and 431 may be positioned so that the additional rotation between the coring and severing positions occurs about a center of rotation that is substantially coincident with the distal cutting end of the coring bit assembly 160.

The torque applied to sever the core may be monitored to determine when the core has been severed from the formation F. For example, the first piston 325 may be instrumented with a pressure gauge to monitor the hydraulic pressure during the severing operation. Additionally or alternatively, the piston 325 may be provided with a position sensor (e.g., a linear potentiometer) configured to monitor the position of the bit housing. The torque applied to the core may be computed from the measured position and/or the measured hydraulic pressure. As the piston 325 is actuated to sever the core, the torque will usually increase until severing of the core from the formation F is achieved, and then drop suddenly. A sudden drop may be used to detect severing of the core and initiate retrieval of the core and coring bit assembly 160 from the formation F. Further, the maximum torque before rupture or severing may indicate formation properties such as the formation tensile strength. Outputs of the position sensor and/or the pressure gauge may be provided to an operator at the surface via the example telemetry module 145, the example wire 115, the example control and data acquisition system 120, and the example controller 125.

The example pistons 325 and 340 and the coring motor 205 may be hydraulically driven by the respective motors and/or hydraulic sources 215 and 240 (FIG. 2). For example, the first motor 215 may be used to rotate and/or apply torque to the coring bit assembly 160 and the second motor 240 may be used to extend and/or apply the WOB to the coring bit assembly 160. The motors and/or hydraulic sources 215 and 250 may be powered via any number and/or type(s) of devices. For example, the motors and/or hydraulic sources 215 and 240 may be powered via the example cable 115 (FIG. 1A) and/or by a mud-driven alternator for while-drilling applications.

As described in U.S. Patent Publication 2009/0114447, entitled "Coring Tool and Method," and published May 7, 2009, the example coring module 150 may also implement a system for efficiently ejecting, handling and storing multiple core samples.

The example coring bit assembly 160 may be configured to retain a core sample and/or core holder within the coring bit assembly 160 until it is to be discharged, ejected or stored. As best shown in FIG. 4B, the example coring bit assembly 160 includes a coring bit comprising the example hollow coring shaft 460 and one or more cutting elements 461 on its distal end. The coring bit assembly 160 further includes the example thrust ring 462 coupled to the coring shaft 460 by the thrust bearing 463. The thrust ring 462, in turn, is coupled to the coring housing 320 via the alignment rods 422. The core holder or sleeve 464 is disposed inside the coring shaft 460 and includes a core gripper such as one or more protrusions 465. The example core sleeve 464 may be configured to not rotate even while the coring shaft 464 and cutting element 461 rotate to reduce the rotation forces applied to the core sample. Because the example core sleeve 464 may be configured not to rotate, it also be referred to herein as a static sleeve 464. However, the static sleeve 464 does move longitudinally with the coring bit assembly 160. Such reductions in rotational or shear force(s) may be particularly advantageous for weaker and/or less consolidated formations F. As described below, the protrusions 465 may form, create, score and/or otherwise mark the core while the core is still in the formation F. Such markings may be used to identify and/or determine the orientation of the core sample with respect to a longitudinal axis of the wellbore 110. Additional details regarding the example sleeve 464 and the example protrusions 465 are described below in connection with FIG. 5. Other example coring shafts 460 are described in U.S. Patent Application Publication No. 2004/0140126, entitled "Coring Bit with Uncoupled Sleeve," and published Jul. 22, 2004, which is hereby incorporated by reference in its entirety.

The example sleeve 464 may be configured to provide a mud passageway 472 between the sleeve 464 and the coring bit shaft 460. For example, the sleeve 464 may be spaced apart from the shaft 460 while remaining behind the cutting face of the coring bit assembly 160. As shown in FIG. 4B, the sleeve 464 may include a plurality of holes and/or ports, one of which is designated at reference numeral 473, to enable the flow of mud from the inner portion of the sleeve 464 into the mud passageway 472 and toward the cutting surfaces 461. Such a flow of mud may be used to clear formation cuttings away from the cutting surfaces 461, lubricate the cutting surfaces 461 and/or cool the cutting surfaces 461. The example ports 473 may be positioned such that a core cannot obstruct the ports 473. Mud circulation may be provided by the negative pressure formed by the rotation of the cutting surfaces 461. Additionally or alternatively as discussed below in connection with FIG. 6, the shaft 460 may be provided with vanes, ribs and/or grooves to force and/or pump mud through the passageway 472 toward the cutting surfaces 461. The circulation of the mud through the cutting elements 461 may reduce the amount of power required to drill a core within an acceptable duration of, for example, 5 minutes. Under limited available downhole power conditions, the mud flow may also enable the drilling of larger diameter and/or longer core samples.

As best shown in FIGS. 4A and 4B, the coring bit assembly 160 may contain one or more weak points and/or grooves at preselected locations, one of which is designated at reference numeral 480, that permit the coring bit assembly 160 to be sheared and/or broken were the coring bit assembly 160 to become stuck and/or lodged in the formation F such that the coring bit assembly 160 cannot be removed and/or retrieved. While breaking the coring bit assembly 160 leaves a portion of the coring bit assembly 160 in the formation F, that may be preferable to having the wireline assembly 105 stuck in the wellbore 110. The plurality of weak points and/or grooves 480 enable the coring bit assembly 160 to be broken at a point close to the coring tool housing 320 when the coring bit assembly 160 experiences a shear load exceeding a predetermined threshold.

Figure 5:
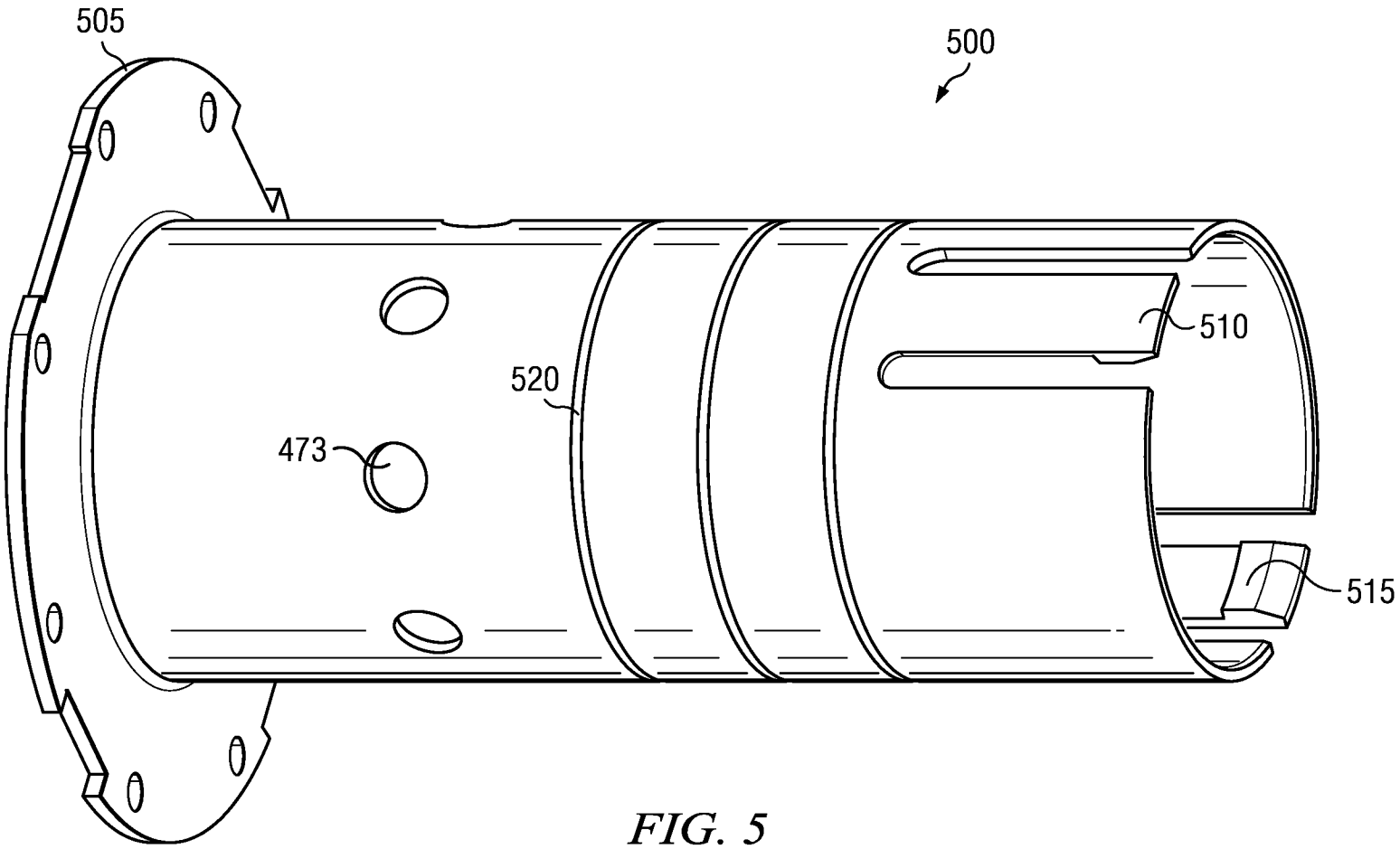
FIG. 5 depicts a coring sleeve according to one or more aspects of the present disclosure.

FIG. 5 depicts a perspective view of an example sleeve 500 according to one or more aspects of the present disclosure. The example sleeve 500 of FIG. 5 may be used to implement the example core or static sleeve 464 of FIGS. 4A-D. The example static sleeve 500 of FIG. 5 includes a flange 505 configured to attach the sleeve 500 to the example thrust ring 462 of the coring bit assembly 160. As described above, the example sleeve 500 may be spaced away from the shaft 460 to form the mud passageway 474 while remaining behind the cutting faces of the cutting elements 461. This may be achieved by attaching the sleeve 500 to the thrust ring 462 using the example flange 505.

The example sleeve 500 may comprise one or more retention members, one of which is designated at reference numeral 510. Each of the example retention member(s) 510 may comprise one or more protrusions, one of which is designated at reference numeral 515. The example protrusion(s) 515 may be configured to create a mark, score or groove on the core as coring bit assembly 160 is extended into the formation F. As the static sleeve 500 is attached to the thrust ring 462, the position of the mark(s), score(s) and/or groove (s) on the core are related to the relative orientation of the formation F from which the core is taken and the axis 315 (FIG. 3A) of the coring tool and, thus, the axis of the wellbore 110. In other words, the mark(s), score(s) and/or groove(s) are indicative of horizontal and/or vertical planes with respect to the wellbore axis. When more than one protrusion 515 is implemented by the static sleeve 505, the protrusions 515 may be rotationally positioned, shaped and/or arranged to enable unambiguous determination of the orientation of the core sample with respect to the formation F. Such markings, scores and/or grooves may be particularly advantageous when taking cores in non-isotropic or anisotropic formations. In such cases, properties of the core and/or the formation F may depend on the direction in which they are measured. When the cores are, for example, analyzed in a laboratory, the properties of the obtained cores may be measured and/or identified with respect to orientation marking(s), score(s) and/or groove(s). These core properties may then be related to formation properties that would be measured along directions relatives to the wellbore axis. The protrusion(s) 515 may also be used for gripping the core once the core is severed from the formation F.

Like the example coring bit shaft 460 described above, the example static sleeve 500 may include any number and/or type(s) of weak points and/or grooves, one of which is designated at reference numeral 520, at preselected locations. The example weak points and/or grooves 520 enable the static sleeve 500 to break and/or shear off when a torque and/or rotational force applied to the static sleeve 500 exceeds a predetermined shear load. The locations of the grooves 520 may match the locations of corresponding grooves 480 provided on the coring shaft 460.

Figure 6:
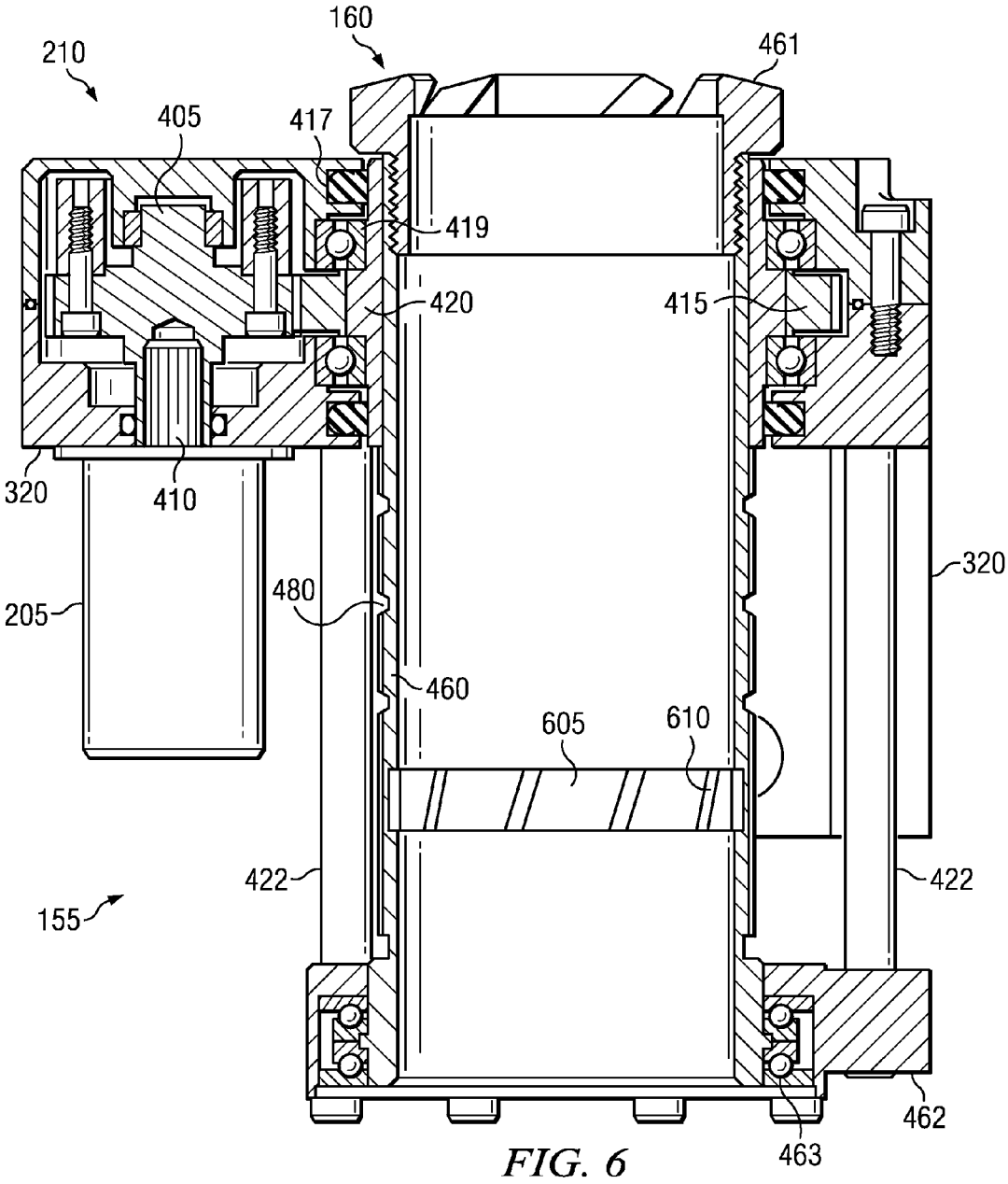
FIG. 6 depicts another example coring apparatus according to one or more aspects of the present disclosure.

FIG. 6 depicts the example coring apparatus 155 of FIG. 4B with the addition of optional axial fluid pump 605. To better illustrate the example axial fluid pump 605, the example sleeve 464 has been removed from the illustration of FIG. 6. The example axial fluid pump 605 of FIG. 6 may be affixed to the coring shaft 460 and may be configured to engage with the outer surface of the sleeve 464. The example axial fluid pump 605 may include one or more spaced ribs, vanes and/or grooves, one of which is designated at reference numeral 610. The ribs and/or grooves 610 may be spiraled as shown in FIG. 6. As the coring shaft 460 rotates, the example axial fluid pump 605 rotates. The rotating ribs and/or grooves 610 of the rotating axial fluid pump 605 create a positive fluid pressure to force and/or drive mud through the mud passageway 472 toward the cutting elements 461.

In view of the foregoing description and the figures, it should be clear that the present disclosure introduces coring apparatus and methods to use the same. According to certain aspects of this disclosure, an example apparatus includes a housing that is selectively pivotable in a downhole tool, a rotatable coring bit, a gear drive rotatively coupled to the housing, a key member configured to engage an inner surface of the gear drive and an outer surface of the coring bit and configured to maintain a rotational relationship between the coring bit and the gear drive, a pinion rotatively coupled to the housing, the pinion configured to engage an outer surface of the gear drive, and a motor affixed to the housing and operatively coupled to the pinion, wherein the gear drive, the key member, the pinion and the motor are configured to pivot in unison with the housing.

According to other aspects of this disclosure, another example apparatus includes a tool housing adapted for suspension within a wellbore in a subterranean formation at a selected depth, a coring aperture formed in the tool housing, a bit housing selectively pivotable within the tool housing, a coring bit mounted within the bit assembly, the coring bit being movably disposed in the bit housing, a bit motor operably coupled to the coring bit and adapted to rotate the coring bit, the bit motor configured to pivot in unison with the bit housing, a series of pivotably connected extension link arms having a first end pivotably coupled to the bit housing and a second end pivotably coupled to the tool housing, a first actuator operably coupled to the series of extension link arms and adapted to longitudinally translate the coring bit, and an axial fluid pump configured to move a fluid toward a cutting element of the coring bit.

According to further aspects of this disclosure, yet another example apparatus includes a tool housing adapted for suspension within a wellbore in a subterranean formation at a selected depth, a coring aperture formed in the tool housing, a bit housing selectively pivotable within the tool housing, a coring bit mounted within the bit assembly, the coring bit being movably disposed in the bit housing, a bit motor operably coupled to the coring bit and adapted to rotate the coring bit, the bit motor configured to pivot in unison with the bit housing, a series of pivotably connected extension link arms having a first end pivotably coupled to the bit housing and a second end pivotably coupled to the tool housing, a first actuator operably coupled to the series of extension link arms and adapted to longitudinally translate the coring bit, and a sleeve disposed inside a hollow shaft of the coring bit, the sleeve configured to at least one of groove, mark or scratch a core sample to indicate an orientation of the core sample relative to the wellbore.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus for conveyance via wireline or drillstring in a wellbore extending into a subterranean formation, the apparatus comprising:

a coring bit assembly comprising:

a coring shaft;

a thrust ring coupled to an end of the coring shaft; and a static sleeve disposed inside the coring shaft and having a flange coupled to the thrust ring to space the static sleeve from the coring shaft to form a drilling fluid passageway between the coring shaft and the static sleeve;

a first motor operatively coupled to the coring bit assembly via a gear box to rotationally drive the coring bit assembly;

a second motor to drive the coring bit assembly into the formation while the coring bit assembly is rotated by the first motor; and an axial fluid pump disposed on the coring shaft to engage with the static sleeve to drive drilling fluid through the drilling fluid passageway.

2. The apparatus of claim 1 further comprising a first feature disposed on the coring shaft and a second feature disposed on the static sleeve and aligned with the first feature, wherein the first and second features permit the coring bit assembly to be broken when the coring bit assembly becomes stuck in the formation, and wherein the first and second features each comprise one or more weak points, grooves, or a combination thereof, to enable the coring bit assembly to be broken.

3. The apparatus of claim 2 wherein the first and second features enable the coring bit assembly to be broken when a torque or rotational force on the coring bit assembly exceeds a predetermined load.

4. The apparatus of claim 1 further comprising a storage area to store core samples taken from the formation via operation of the coring bit assembly.

5. The apparatus of claim 1 further comprising a brace arm to stabilize the apparatus in the wellbore when the coring bit assembly is operating by engaging the brace arm against the surface of the wellbore.

6. The apparatus of claim 1 wherein the coring bit assembly is to extend up to about 3 inches into the formation.

7. The apparatus of claim 6 wherein the coring bit assembly is to create a coring sample having an outer diameter of at least about 1.5 inches.

8. The apparatus of claim 1 wherein the coring bit assembly is to create a coring sample having an outer diameter of at least about 1.5 inches.

9. The apparatus of claim 1 wherein the apparatus has an overall diameter of less than about 5.25 inches.

10. The apparatus of claim 1 wherein the axial fluid pump comprises one or more vanes, ribs, or a combination thereof, disposed on the coring shaft.

11. An apparatus, comprising:

a housing that is selectively pivotable in a downhole tool that is for conveyance via wireline or drillstring in a wellbore extending into a subterranean formation;

a rotatable coring bit comprising:

a coring shaft;

a cutting element coupled to a first end of the coring shaft;

a thrust ring coupled to the housing and to a second end of the coring shaft opposite of the first end;

a sleeve disposed in the coring shaft and having a flange coupled to the thrust ring to space the sleeve from coring shaft to form a passageway between the coring shaft and the sleeve; and an axial fluid pump disposed on the coring shaft to engage with the sleeve to drive a fluid through the passageway toward the cutting element;

a gear drive rotatively coupled to the housing;

a key member to engage an inner surface of the gear drive and an outer surface of the coring bit and to maintain a rotational relationship between the coring bit and the gear drive;

a pinion rotatively coupled to the housing, the pinion to engage an outer surface of the gear drive; and a motor affixed to the housing and operatively coupled to the pinion, wherein the gear drive, the key member, the pinion and the motor pivot in unison with the housing.

12. The apparatus of claim 11 wherein the coring bit assembly is to extend up to about 2.25 inches into the formation.

13. The apparatus of claim 12 wherein the coring bit assembly is to create a coring sample having an outer diameter of at least about 1.5 inches.

14. The apparatus of claim 11 wherein the coring bit assembly is to create a coring sample having an outer diameter of at least about 1.5 inches.

15. The apparatus of claim 11 wherein the apparatus has an overall diameter of less than about 5.25 inches.

16. The apparatus of claim 11 further comprising a first feature disposed on the coring shaft and a second feature disposed on the sleeve and aligned with the first feature, wherein the first and second features permit the coring bit to be automatically severed when a torque or rotational force on the coring bit exceeds a predetermined load.

17. An apparatus, comprising:

a coring bit assembly comprising:

a coring shaft;

a thrust ring coupled to an end of the coring shaft; and a sleeve disposed inside the coring shaft and having a flange coupled to the thrust ring to space the static sleeve from the coring shaft to form a passageway between the coring shaft and the sleeve;

a first motor operatively coupled to the coring bit assembly via a gear box to rotationally drive the coring bit assembly;

a second motor to drive the coring bit assembly into a subterranean formation while the coring bit assembly is rotated by the first motor; and a third motor operatively coupled to the first motor via a gear pump;

an axial fluid pump disposed on the coring shaft to engage with the static sleeve to drive a fluid through the passageway;

wherein the coring bit assembly comprises one or more weak points, grooves, or a combination thereof, to enable the coring bit assembly to be broken when a torque or a rotational force on the coring bit assembly exceeds a predetermined load.

18. The apparatus of claim 17 further comprising a storage area to store core samples taken from the formation via operation of the coring bit assembly.

19. The apparatus of claim 17 further comprising a brace arm to stabilize the apparatus in the wellbore when the coring bit assembly is operating by engaging the brace arm against the surface of the wellbore.

20. The apparatus of claim 17 wherein the coring bit assembly is to extend up to about 3 inches into the formation.

21. The apparatus of claim 17 wherein the coring bit assembly is to create a coring sample having an outer diameter of at least about 1.5 inches.

22. The apparatus of claim 17 wherein the apparatus has an overall diameter of less than about 5.25 inches.

23. The apparatus of claim 17 wherein the static sleeve comprises a protrusion to create a mark on core samples.

24. The apparatus of claim 17 wherein the sleeve comprises a plurality of holes to direct the fluid from an interior of the sleeve into the passageway towards a cutting element disposed on an end of the coring shaft.

25. The apparatus of claim 17 wherein the static sleeve comprises a gripper to retain core samples.

* * * * *